US008469458B2

(12) United States Patent
Bechem et al.

(10) Patent No.: US 8,469,458 B2
(45) Date of Patent: Jun. 25, 2013

(54) ROLLER DRILL OR ROLLER BIT

(75) Inventors: Ulrich Bechem, Iserlohn (DE); Philip Bechem, Iserlohn (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 467 days.

(21) Appl. No.: 12/675,802

(22) PCT Filed: Sep. 18, 2007

(86) PCT No.: PCT/EP2007/008120

§ 371 (c)(1),
(2), (4) Date: Apr. 19, 2010

(87) PCT Pub. No.: WO2009/036781

PCT Pub. Date: Mar. 26, 2009

(65) Prior Publication Data

US 2010/0219676 A1 Sep. 2, 2010

(51) Int. Cl.
*E21C 25/18* (2006.01)

(52) U.S. Cl.
USPC ..... 299/110; 299/111

(58) Field of Classification Search
USPC ..... 299/105, 106, 111, 112, 113
See application file for complete search history.

(56) References Cited

U.S. PATENT DOCUMENTS 1,174,433 A * 3/1916 Mowlds ..... 299/100
4,783,123 A * 11/1988 Ottestad ..... 299/100
4,906,294 A * 3/1990 von Haas et al. ..... 75/228
5,078,219 A * 1/1992 Morrell et al. ..... 299/111
5,333,938 A * 8/1994 Gale ..... 299/106
5,456,522 A * 10/1995 Beach ..... 299/113
5,520,444 A * 5/1996 Kosobrodov et al. ..... 299/106

FOREIGN PATENT DOCUMENTS

| | | |
|---|---|---|
| CH | 675387 | 9/1990 |
| DE | 862584 | 1/1953 |
| DE | 9105472 | 7/1991 |
| DE | 19740078 | 3/1999 |
| DE | 19838195 | 3/2000 |
| EP | 1 138869 | 10/2001 |
| EP | 1291490 | 3/2003 |
| WO | WO 92/10647 | 6/1992 |

OTHER PUBLICATIONS

International Search Report, dated Jun. 25, 2008, for PCT/EP2007/008120, Filed Sep. 18, 2007.

* cited by examiner

*Primary Examiner* — John Kreck
(74) *Attorney, Agent, or Firm* — Foley & Lardner LLP

(57) ABSTRACT

A roller drill for removing material, such as in particular rock, minerals or the like, according to the undercutting principle, comprising a cutting face which is formed concentrically around a central axis and widens conically toward an end face of the roller drill, and includes a supporting body which is arranged on the inner side of the cutting face and extends up to the end face of the tool. In order to provide a roller drill or a roller bit of which the tool life or service life is improved compared with the prior art, the cutting face is made of a harder material than the supporting body and the supporting body forms an annular web which is conical at least at an outer circumferential wall and which defines with its inner circumferential wall a free space at the end face of the tool. The tool can resharpen itself automatically due to the free space and the dissimilar material combination.

32 Claims, 4 Drawing Sheets

ROLLER DRILL OR ROLLER BIT

This application claims priority to and the benefit of the filing date of International Application No. PCT/EP2007/008120, filed Sep. 18, 2007, which application is incorporated by reference into the specification of this application.

The invention relates to a roller drill or a roller bit for removing material, such as in particular rock, minerals or the like, according to the undercutting principle, comprising a cutting face which is formed concentrically around a central axis and widens conically toward the end face of the roller drill, and comprising a supporting body which is arranged on the inner side of the cutting face and extends up to the end face of the tool.

BACKGROUND OF THE INVENTION

Different types of cutting systems with which work can be carried out in the field of mining or of road construction by means of roller drills or roller bits according to the undercutting principle are known in the prior art. Roller drills or roller bits which work according to the undercutting principle are characterized by one-sided, conical tool bodies or disks which are mounted on drilling heads or tool arms of, for example, heading machines in such a way that the roller drills can rotate freely about their central axis. The material, such as in particular rock, hard rock or mineral rock, is removed in thin layers according to the undercutting principle. The material is broken out in mostly palm-of-the-hand-sized pieces by the cutting faces, which widen conically starting from the drilling head and detach the rock in thin layers with an undercutting action. In order to achieve a high removal rate, usually a plurality of roller bits or roller drills are mounted on a rotatable drilling head or on a drilling head which is rotationally driven at high speed with superimposed impact (cf., e.g., DE 198 38 195 A1 or WO 92/10647).

Since the roller drills or roller bits working according to the undercutting principle and having conically widening cutting faces formed only on one side are applied obliquely to the rock face to be removed, the cutting faces of the roller bits and in particular the cutting edge at the transition between the cutting face and the end face are subjected to axial forces which, due to the system used, are high. The axial forces in turn cause, in particular on the cutting edge at the free margin of the cutting face, system-related rapid wear of the individual roller bits.

SUMMARY OF THE INVENTION

The invention of this application relates to a roller drill or a roller bit of which the tool life or service life is improved compared with the prior art.

More particularly provided is a cutting face that is made of a harder material than the supporting body and in that the supporting body forms an annular web which runs conically at least at its outer circumferential wall and which defines with its inner circumferential wall a free space at the end face of the tool. The interplay between the dissimilar material combination of hardened or harder cutting face and softer supporting body on the one hand and the free space in the supporting region of the supporting body, i.e. as viewed radially in each case behind the cutting face, on the other hand achieves the situation where the cutting edge at the transition between the cutting face and the end face can resharpen itself automatically over a comparatively long period of time. The self-resharpening effect is achieved in particular by virtue of the fact that, when the hardened cutting face wears down, the softer material of the supporting body located behind said cutting face is also worn away by the rock to be removed, as a result of which only the hardened cutting face is substantially in constant contact with the material to be removed.

In order to achieve the effect of the automatic resharpening of the tool according to the invention, it is not absolutely necessary for the free space to be designed as a cavity or the like; the free space, in the radial direction behind the supporting body, could also be filled with a material that is even softer than the material of the supporting body. In a preferred configuration, however, the free space in the back of the supporting body is designed as a hollow recess. It is advantageous if the free space extends from the end face of the tool at least partly over the axial extent of the cutting face of the tool. The deeper the free space in the axial direction, the greater is the effective axial length of the cutting face at which automatic resharpening of the cutting edge of the roller bit can be achieved. In addition, the worn-away material of the supporting body can collect temporarily in the cavity behind the supporting body.

In one embodiment, the annular web has an exactly constant thickness or a substantially constant thickness between its inner circumferential wall and its outer circumferential wall. This configuration has the advantage that the roller drill, introduces, throughout its entire resharpening service life, the same restoring forces into the machine on which the roller drills are used, since, irrespective of the degree of wear, therefore irrespective of the axial shortening of the cutting face made of hardened material, the same cross section of softer supporting body material has to be worn away in order to achieve the situation where only the cutting edge made of harder material is in operative engagement with the rock to be removed. To this end, the inner circumferential wall expediently runs conically, as a result of which the free space or the recess likewise tapers conically toward the root of the free space. According to an advantageous configuration, the cone angle of the inner circumferential wall and the cone angle of the cutting face can be substantially the same. Depending on the material combination used, it may be sufficient if the thickness of the annular web is only approximately constant. In this case, the cone angle of the inner circumferential surface and the cone angle of the cutting face can differ from one another by less than 8°, in particular less than 5', preferably less than 2°. Depending on the material combination used, the web thickness may also vary, the web thickness as a rule being made usually two to ten times thicker than the radial thickness of the cutting face. On the whole, the web thickness should be made as thin as possible in order for it to be possible for the likewise softer material to be worn away quickly.

According to the invention, roller bits or roller drills having hardened cutting faces supported radially by means of annular supporting bodies can be constructed in different ways. According to an advantageous configuration, the supporting body has a cylindrical neck section and a conical collar section, which forms the annular web. In one embodiment, the cutting face can then consist of surface hardening or a hard coating applied to the conically running outer circumferential wall of the annular web. Alternatively, the cutting face can consist of cutting segments or carbide segments fastened to the conically running outer circumferential wall of the annular web. The cutting segments or carbide segments can be fastened to, in particular brazed to, or brazed in place on, the outer circumferential wall of the annular web of the supporting body. The use of cutting segments has the advantage that the concentrically encircling cutting face can be produced relatively simply. In order to protect corresponding cutting segments or carbide segments from damage by shock loading or chipping even under the highest axial loads, the cutting segments or carbide segments can be covered by means of at least one ring or a covering layer which is made of a softer material than the cutting face. A corresponding ring or a corresponding covering layer therefore provides for additional fixing of the cutting segments and thus of the cutting face on the supporting body. The material of the ring or of the covering layer is expediently also softer than the material of the annular web, in order that the resharpening effect of the tool according to the invention is not adversely affected.

According to an alternative embodiment, the cutting face can be an integral part of a cutting ring which has a cylindrical neck section and a conical collar section, the supporting body bearing against, or being formed on, the inner side of said collar section. The entire cutting ring can then be made of carbide or some other wear-resistant material. In order for it to be possible to fasten corresponding roller drills in a simple manner to tool shafts of the heads of driven machines for material removal, the cutting ring or the supporting body has in one embodiment, at the inner lateral surface of the neck section, a bevel for a clamping disk which interacts with the level and can be detachably connected to a tool shaft. In this case, the neck section can at the same time be provided with a shaft head receptacle for accommodating an end of a tool shaft, preferably in a rotationally fixed manner. The clamping disk can also have a clamping collar with bevel and can be connected to an end of a tool shaft by means of a screw. As a further alternative, the supporting body can bear with its annular web in a detachable manner against the inner side of the cutting ring and can have a base which is integrally connected to the annular web and which can be clamped axially against the neck section of the cutting ring by a screwing means which can be screwed into the end of a tool shaft.

The roller drills or roller bits according to the invention can especially advantageously be connected to the one end of a tool shaft which is supported in a shaft receptacle of a machine head by means of two bearings arranged on the circumference of a shank of the tool shaft and by means of a thrust bearing axially supporting the other, free shaft end. Corresponding mounting of the tool shafts for roller drills on machine heads is of independent inventive significance and can also be used in the case of roller drills which have one-piece cutting faces made of a single material or of a material of uniform hardness.

The supporting body can be made, for example, of steel and the cutting face can consist of surface hardening or a hard coating, applied for example by build-up welding, on the outer circumference of the supporting body, or different materials such as, for example, carbide for the cutting face, the cutting ring or the cutting segments and steel or the like for the supporting body are suitable from the outset.

These and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 2:
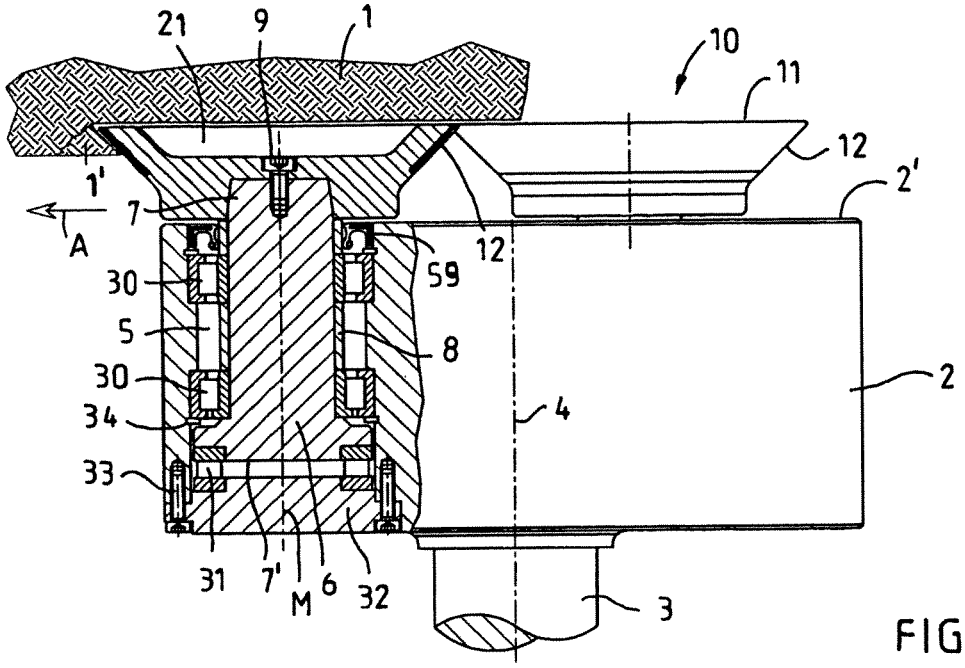
FIG. 2 shows the machine head from FIG. 1 in side view, partly broken away.
Figure 1:
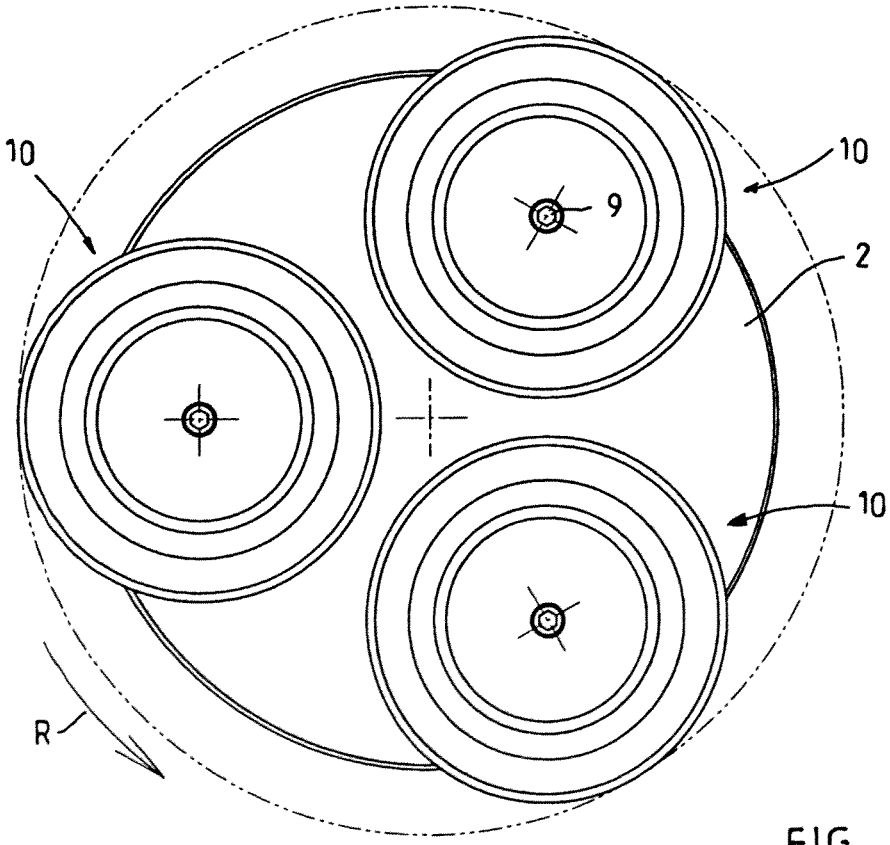
FIG. 1 schematically shows, in a highly simplified manner, a plan view of the head of a machine working according to the undercutting principle and having a plurality of roller bits according to the invention mounted on the machine head.

Referring now to the drawings wherein the showings are for the purpose of illustrating preferred and alternative embodiments of the invention only and not for the purpose of limiting same, FIGS. 1 and 2 show, of a machine (otherwise not shown in any more detail) for removing material such as rock at a schematically shown working face 1, a machine head 2 which rotates about the central axis 4 of the machine head 2 by means of the drive shaft 3. The machine head 2 can be mounted, for example via the drive shaft 3, on a tunneling machine, a heading machine, a selective-cut or full-thickness machine or a machine working with superimposed impact. In the exemplary embodiment shown, the machine head 2 has three shaft head receptacles 5, in each of which a tool shaft 6 is mounted. A roller drill designated overall by reference numeral 10 and working according to the undercutting principle is fastened in a rotationally fixed manner to the free end 7 of each tool shaft 6, said shaft end 7 projecting from the machine head 2 at the front side 2'. As can already be easily seen in FIG. 2, the roller drills or roller bits 10 are cutting disks which are conical on one side and which have a cutting face 12 on the circumference, said cutting face 12 widening conically toward the free end face 11. The tool shafts 6 are mounted in the receptacles 5 such as to be rotatable about the rotation axis M of the tool shafts 6, and the mounting is effected by means of two radial bearings 30, which bear against the shank of the tool shaft 6 and are spaced apart via a sleeve 8, and by means of a further, thrust bearing 31 which bears against the rear shaft end 7' and abuts against a cover plate 32 which is fastened to the rear side of the machine head 2 by means of a plurality of screws 33 and closes the shaft receptacle 5. When the roller bits 10 and retaining ring 34 are removed, the tool shafts 6 can be removed from the shaft receptacles 5 at the rear side of the machine heads 2. The top radial bearing 30 in FIG. 2 forms a floating bearing and the bottom radial bearing 30 forms a fixed bearing. The entire shaft receptacle 5 is protected against the ingress of dirt and moisture by means of a shaft seal 59. The thrust bearing 31 provides for extremely favorable support of the tool shafts 6 at the rear shaft ends 7' even under high axial forces, which may occur at the working face 1 when pieces 1' of material are broken off with an undercutting action—as indicated in FIG. 2.

During operational use, the machine head 2 is moved in working direction A by pivoting arms or by a movement of the driven machine. At the same time, the machine head 2 rotates about the central axis 4 in arrow direction R (FIG. 1). Since the tool shafts 6 are mounted in a freely rotating manner, the roller bits 10 can also move rotationally about the central axis M, as a result of which the cutting faces 12, which are shown as thick black lines on the sectioned roller bit 10 in FIG. 2, can wear down uniformly over the circumference. The material to be removed is removed in layers, with undercutting action, in the direction of arrow A by the rotational movement of the machine head 2 and by the conical or wedge-shaped cutting face 12 on the roller bits 10.

Figure 3:
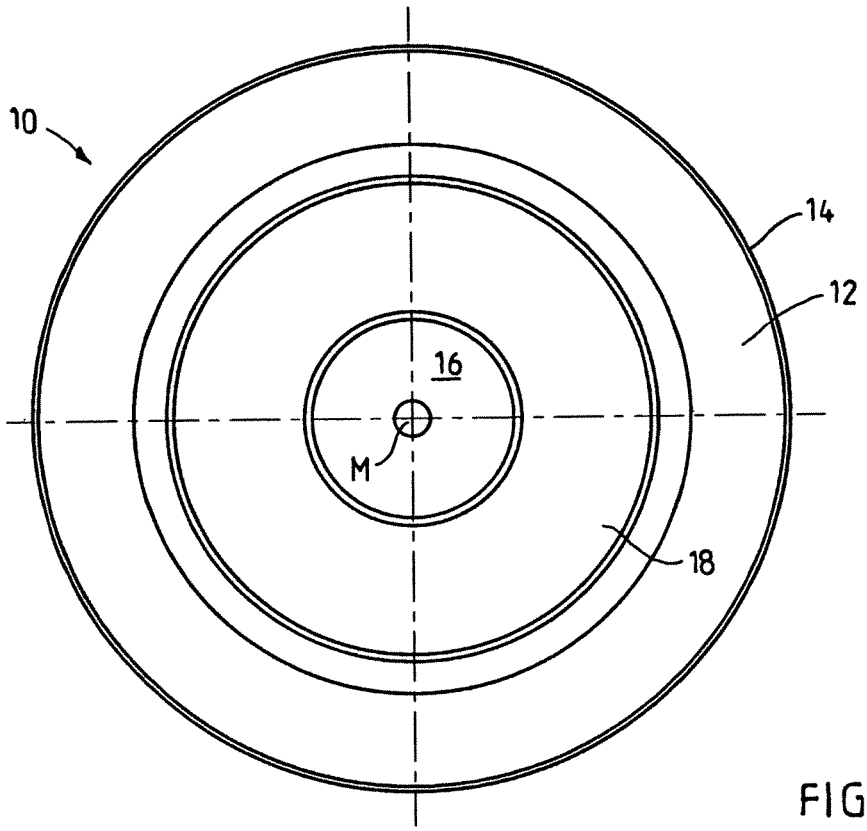
FIG. 3 shows a roller drill according to the invention in a plan view of the end face.
Figure 4:
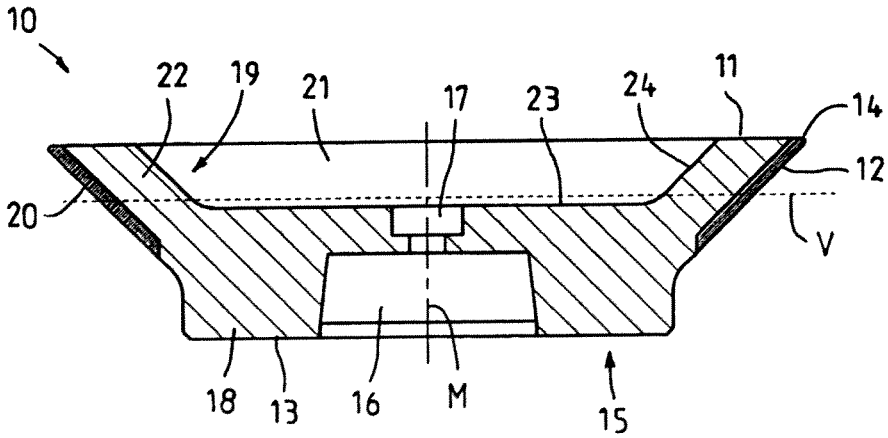
FIG. 4 shows a horizontal section through the roller drill from FIG. 3.

FIGS. 3 and 4 show the roller bit 10 from FIGS. 1 and 2 in detail. FIG. 3 forms a view of the underside 13 which faces the machine head in operational use and has the cutting face 12 widening conically toward the outer circumference 14. The roller bit 10 has a solid, one-piece supporting body 15 which is provided integrally with a shaft head receptacle 16 for the free end of the tool shaft (7, FIG. 2) and, concentrically relative to the central axis M, with a central bore 17 for a fastening screw (9, FIG. 2) in order for the supporting body 15 to be connected to the end of the tool shaft in a rotationally fixed manner. The supporting body 15, which can be made in particular of steel, has a neck section 18 which is cylindrical at the circumference and which extends from the underside 13 of the roller bit 10. The neck section 18 merges integrally into a conically widening collar section 19. The cutting face 12 is formed on the conical outer circumferential wall 20 of the collar section 19 of the supporting body 15 and consists here of surface hardening or a built-up carbide layer. According to the invention, the cutting face 12 is made of a material that is preferably distinctly more wear-resistant and harder than the material of the supporting body 15. The carbide coating overlay or surface hardening forming the cutting face 12 runs in a uniformly encircling manner over the outer circumferential wall 20 of the collar section 19. The end face 11 of the roller bit 10 this end face being remote from the shaft head receptacle 16 and running at right angles to the central axis M, is at the same time provided with a central recess 21, which in this case extends over about one third of the axial length of the supporting body 15. The recess 21, which can be, for example, a turned recess on the end face 11 of the supporting body 15 or a recessed portion produced in some other way, forms a free space which limits the cross section of the material provided at the end face 11 by the supporting body 19 to a narrow annular web 22. In the radial direction, i.e. perpendicularly to the central axis M of the roller bit 10, the narrow annular web 22 has a uniform thickness from the root 23 of the recess 21 up to the end face 11. The recess 21 forms a free space and effects or assists, in conjunction with the dissimilar material combination of harder cutting face 12 and softer, web-like supporting body 15, automatic resharpening of the cutting face 12 of the roller bit 10. Since, during removal with undercutting action, the cutting face 12 is in engagement with the material to be removed, the cutting face 12 wears down slowly in particular at the marginal edge 14. However, as soon as the cutting edge 14 has worn down, the substantially softer material of the supporting body is also worn away immediately at the end face 11 by the material to be removed, for which reason a neatly angled and hardened cutting edge 14 at the transition between the cutting face 12 and the end face 11 is always in active engagement with the material to be removed. This automatic resharpening effect occurs right up to the wear limit line V which is indicated in FIG. 4 and which is located slightly above the root 23 of the recess 21 and up to which each roller bit 10 can be worn down if the restoring forces which are introduced into the machine head remain substantially constant. The constant radial wall thickness of the annular web 22 is substantially facilitated in the roller bit 10 in FIGS. 3 and 4 by virtue of the fact that the inner circumferential wall 24 of the collar section 19, designed as annular web 22, of the supporting body 15 runs substantially at the same cone angle or angle of slope to the central axis M as the cutting face 12 and the outer circumferential wall 20. In the exemplary embodiment shown, the cone angle or angle of slope is about 45°.

Figure 5:
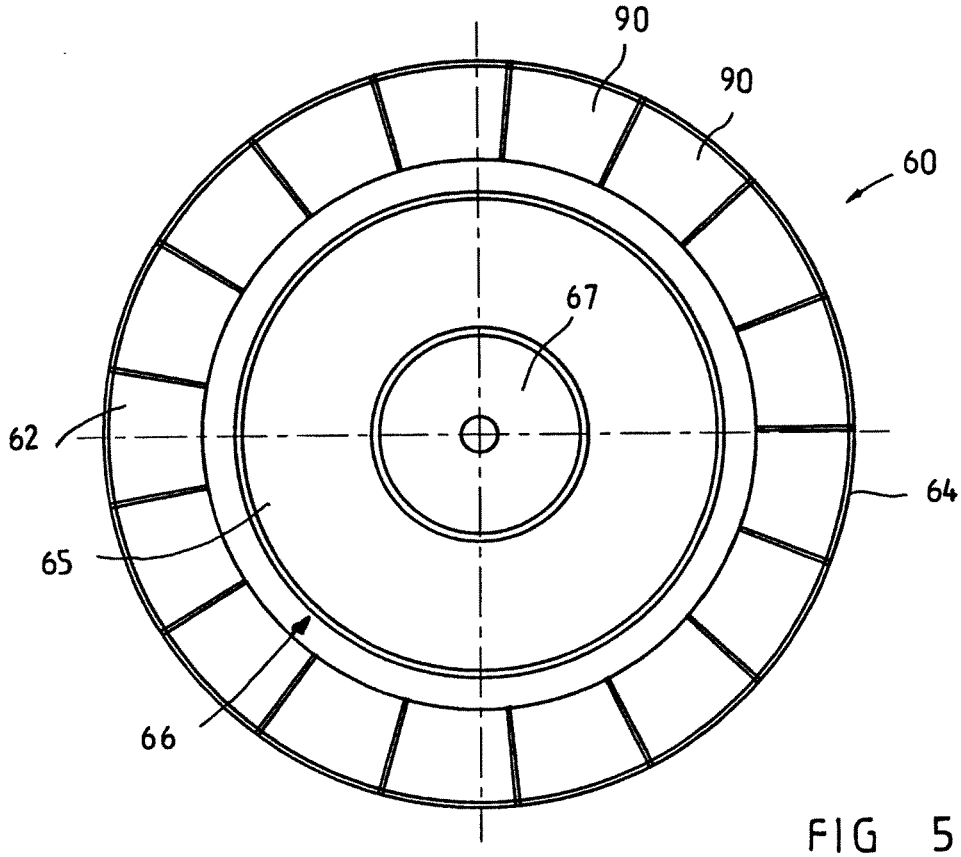
FIG. 5 shows a roller drill according to a second exemplary embodiment in a plan view of the cutting face.

FIG. 5 shows a roller bit 60 according to a further exemplary embodiment. As in the previous exemplary embodiment, the roller bit 60 has a one-piece supporting body 65 having a cutting face 62 widening conically to the outer edge 64. A shaft head receptacle 67 for the end of a tool shaft is formed centrally on the underside of the supporting body 65, once again in a cylindrical neck section 66. In contrast to the previous exemplary embodiment, however, the cutting face 62 does not consist of surface hardening or a built-up layer; rather the conically widening cutting face 62 is formed by means of a plurality of cutting segments, here for example seventeen cutting segments, which are brazed to a conical outer circumferential wall of the supporting body 65 or are fastened thereto in some other way. According to the invention, each cutting segment 90 has markedly greater hardness than the material of the supporting body 65, and, radially behind a collar section, on the conically widening outer circumferential wall of which the cutting segments 90 are supported, the supporting body 65 has an annular web which is provided with a recess as free space in order for an automatic resharpening effect also to be achieved in the case of a cutting face 62 formed by cutting segments 90.

Figure 6:
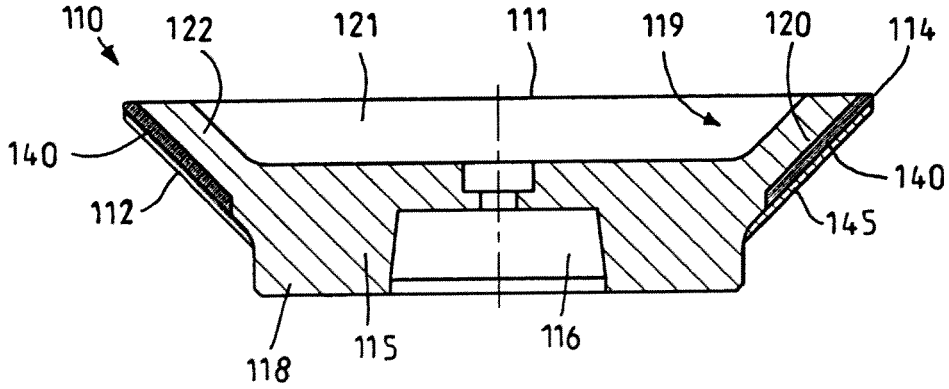
FIG. 6 shows a roller drill with cutting segments according to a third exemplary embodiment.

FIG. 6 shows a further exemplary embodiment for a roller bit 110 having a solid, one-piece supporting body 115 which has integral in it a neck section, which encloses the shaft head receptacle 116, and a conically widening collar section 119 which adjoins said neck section and is provided centrally with a recess 121, such that only an annular web of constant thickness is formed, as supporting part of the supporting body 115, on the back of the cutting face 112. As in the exemplary embodiment in FIG. 5, the cutting face 112 does not consist of circumferential hardening, but rather of individual cutting segments 140 which are brazed to the conically outwardly widening outer circumferential wall 120 of the annular web 122. In contrast to the previous exemplary embodiment, all the cutting segments 140 are covered circumferentially with a covering layer 145 over the entire axial length of the cutting face 112. In the exemplary embodiment shown, the covering layer 145 extends approximately from the cutting edge 114, at the transition between the cutting face 112 and the end face 111, up to the cylindrical circumference of the neck section 118. Instead of a continuous covering layer, one or more rings could also run around the individual segments 140 in order to assist the anchoring thereof on the annular-web-like supporting body in the region of the collar section 119. The material of the covering layer 145 or of the rings is preferably both considerably softer than the material of the cutting segments 140 and also softer than, or of a similar degree of softness to, the material of the supporting body 115. The covering layer 145 can be for example brazed in place.

Figure 7:
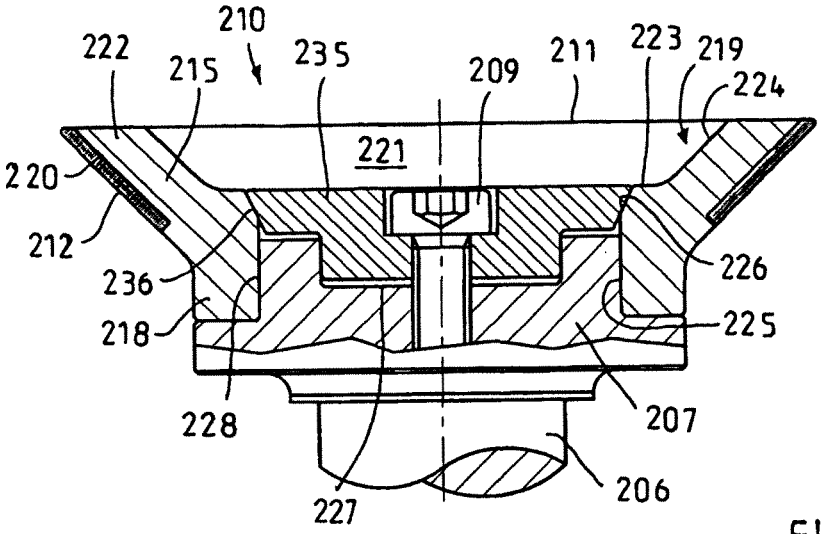
FIG. 7 shows a roller drill according to a fourth exemplary embodiment in a sectional view.

FIG. 7 shows a roller bit 210 in which a supporting body 215 has, once again, a neck section 218 and a conically widening collar section 219 which, on account of a recess 221 in the end face 211, is tapered radially behind the cutting face 212 to form an annular web 222 having a conically running outer circumferential wall 220 and an inner circumferential wall 224 running parallel thereto. The cutting face 212 consists of surface hardening, a brazed-on wear layer or attached cutting segments and is harder than the material of the supporting body in the annular web 222. Here, the supporting body 215 is fastened to the end 207 of a tool shaft 206 in a rotationally fixed manner by means of a separate clamping disk 235 which can be screwed against the shaft end 207 by means of a fastening screw 209. The shaft end 207 is of multi-step design and has a blind hole 227 in the center and a step 228 on the outside. The neck section 218 of the supporting body 215, this neck section being provided with a cylindrical central bore 225, bears against the outer step 228 of the shaft end 207. The supporting body 215 can be pushed with its central bore 225 onto the step 228 at the shaft end 207. Formed at the transition between the central bore 225 and the root 223 of the recess 221 is a sloping clamping surface 226, against which the clamping ring 235, with an opposing slope 236 on its circumference, can be clamped by virtue of the screw 209 being tightened. The interplay between the two sloping clamping surfaces 226, 236 clamps the supporting ring 215 against the shaft end 207, with the result that the supporting ring is fastened to the tool shaft 206 in a rotationally fixed and at the same time detachable manner. The material of the supporting body 215 is considerably softer than the material of the cutting face 212 so that the resharpening effect at the cutting face 212 occurs in interaction with the recess 221.

Figure 8:
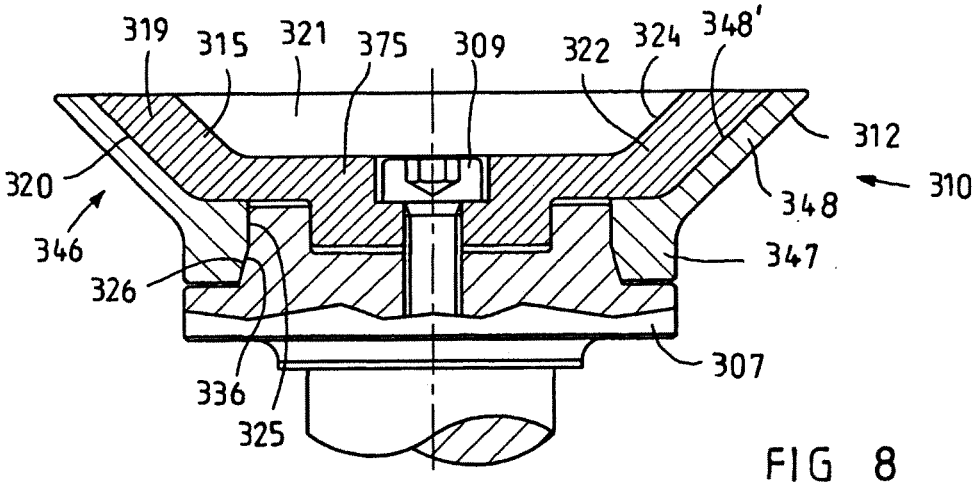
FIG. 8 shows a roller drill according to a fifth exemplary embodiment in a sectional view.

FIG. 8 shows a further exemplary embodiment of a roller bit 310 according to the invention which can be fastened to a multi-step end 307 of a tool shaft. The roller bit 310 has a cutting ring 346 which has a cylindrical neck section 347 and a collar section 348 widening conically outward in the form of a web. With its outer circumferential surface, the collar section 348 forms the cutting face 312 for removing rock with an undercutting action. The entire cutting ring 346 is made of a material that is more wear-resistant than a supporting body 315, which in the roller bit 310 at the same time forms the clamping piece for clamping the cutting ring 346 in place on the shaft end 307 by means of the fastening screw 309. In order to achieve the resharpening effect, the supporting body 315, which at the same time forms the clamping element, has a collar section 319 which widens outward in the form of an annular web and merges into a base section 375 which defines the free space 321 inside the inner circumferential wall 324 of the supporting body 315. The supporting body 315 can bear loosely against the cutting ring 346 or be fixedly connected to the latter, although in the fitted state the collar section 319 in the form of an annular web bears or presses with its outer circumferential wall 320 against the lateral inner surface 348' of the cutting ring 346. The rotationally fixed anchoring of the cutting ring 346 on the shaft end 307 is achieved via the interaction between a clamping slope 326 on the shaft end 307 and a clamping slope 336 at the transition between the underside of the cutting ring 346 and a central bore 325 of the cutting ring 346. In the roller bit 310, too, the respective cutting edge can resharpen itself automatically due to the combination according to the invention of the free space 321 and the dissimilar materials of the cutting ring 346 on the one hand and of the annular web 322 of the supporting body 315 on the other hand, which web taperes in the radial direction behind the cutting face 312.

Figure 9:
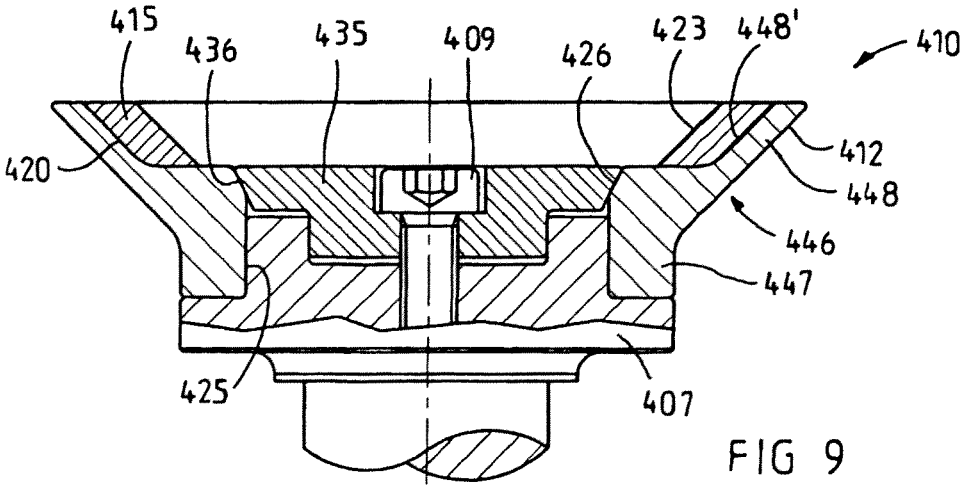
FIG. 9 shows a roller drill according to a sixth exemplary embodiment.

FIG. 9 shows a sixth exemplary embodiment for a roller bit 410 which can be fastened in a rotationally fixed manner once again to a stepped shaft end 407 by means of a fastening screw 409. Here, too, the cutting face 412 is formed on a cutting ring 446 made of carbide or the like and is formed on the cutting ring 446 by the conically widening circumferential surface. The cutting ring 446 is locked on the shaft end 407 by means of a clamping disk 435 which has, at the circumferential margin, a clamping slope 436 which presses against a further clamping slope 426 on the cutting ring 446. In the roller bit 410, however, the supporting body 415 consists only of an annular body of parallelogram-shaped cross section and of an outer circumferential wall 420 and an inner circumferential wall 423 parallel to one another. The supporting ring is brazed to, or anchored on, the inner circumferential surface 448 (428') of the web-like collar section 448 (428) of the cutting ring 446. The supporting ring 415 is made as thin as possible in order to ensure that the cutting face 412 integrally formed on the cutting ring 446 is made stable enough for the undercutting process.

In all the exemplary embodiments, the material of the cutting face is to be of a strength or hardness which is markedly higher than the material of the supporting body. The different degree of hardness can vary depending on the intended use. The use of steel for the supporting body and of carbide applied by build-up welding for the cutting face is only intended by way of example, without limiting the scope of protection thereto. Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A roller drill for removing material, such as in particular rock, minerals or the like, according to the undercutting principle, the roller drill comprising a cutting face which is formed concentrically around a central axis and widens conically toward an end face of the roller drill, the roller drill further including a supporting body which is arranged on the inner side of the cutting face and extends up to the end face, the cutting face being made of a harder material than the supporting body and the supporting body forms an annular web which is conical at least at an outer circumferential wall and which includes an inner circumferential wall which defines a free space at the end face;

wherein the cutting face is an integral part of a cutting ring which is made of a hard material and which has a cylindrical neck section and a conical collar section, the supporting body engaging an inner side of the collar section.

2. The roller drill as claimed in claim 1, wherein the free space includes a recess.

3. The roller drill as claimed in claim 2, wherein the free space extends from the end face at least partly over the axial extent of the cutting face of the tool.

4. The roller drill as claimed in claim 1, wherein the annular web has a substantially constant thickness between its inner circumferential wall and its outer circumferential wall.

5. The roller drill as claimed in claim 1, wherein the inner circumferential wall runs conically.

6. The roller drill as claimed in claim 1, wherein the cone angle of the inner circumferential wall and the cone angle of the cutting face are substantially the same.

7. The roller drill as claimed in claim 1, wherein the cone angle of the inner circumferential wall and the cone angle of the cutting face differ from one another by less than about 8 degrees.

8. The roller drill as claimed in claim 7, wherein the cone angle of the inner circumferential wall and the cone angle of the cutting face differ from one another by less than about 2 degrees.

9. The roller drill as claimed in claim 1, wherein the supporting body has a cylindrical neck section and a conical collar section which at least in part forms the annular web.

10. The roller drill as claimed in claim 1, wherein the cutting face includes a hard coating applied to the conically running outer circumferential wall of the annular web.

11. The roller drill as claimed in claim 1, wherein the cutting face includes a plurality of cutting segments secured to the conically running outer circumferential wall of the annular web.

12. The roller drill as claimed in claim 11, wherein the cutting segments are carbide segments.

13. The roller drill as claimed in claim 11, wherein the cutting segments are at least partially covered by a softer material layer than the cutting face.

14. The roller drill as claimed in claim 13, wherein the softer material layer includes at least one ring.

15. The roller drill as claimed in claim 13, wherein the softer material layer is softer than the material of the annular web.

16. The roller drill as claimed in claim 1, wherein the hard material includes a carbide material.

17. The roller drill as claimed in claim 1, wherein the supporting body is formed into the inner side of the collar section.

18. The roller drill as claimed in claim 9, wherein the supporting body has an inner bore which includes a clamping slope shaped to receive a clamping disk which interacts with the clamping slope for detachably connecting the roller drill to a tool shaft.

19. The roller drill as claimed in claim 18, wherein the clamping disk has a clamping slope with bevel and can be connected to an end of a tool shaft by means of a screw.

20. The roller drill as claimed in claim 1, wherein the cutting ring has an inner bore which includes a clamping slope shaped to receive a clamping disk which interacts with the clamping slope for detachably connecting the roller drill to a tool shaft.

21. The roller drill as claimed in claim 20, wherein the clamping disk has a clamping slope with bevel and can be connected to an end of a tool shaft by means of a screw.

22. The roller drill as claimed in claim 1, wherein the neck section has a shaft head receptacle for accommodating an end of a tool shaft in a rotationally fixed manner.

23. The roller drill as claimed in claim 1, wherein the annular web of the supporting body engages the inner side of the cutting ring, the supporting body further including a base which is integrally connected to the annular web and which can be clamped axially against the neck section of the cutting ring by a screwing means which can be screwed into the end of a tool shaft.

24. The roller drill as claimed in claim 1, wherein the roller drill is connectable to the end of a tool shaft which is supported in a shaft receptacle of a machine head by means of two bearings arranged on the circumference of the shaft shank and by means of a thrust bearing axially supporting the other shaft end.

25. A roller drill for removing material, such as in particular rock, minerals or the like, according to the undercutting principle, the roller drill comprising:

a cutting face which is formed concentrically around a central axis and widens conically toward an end face of the roller drill, the roller drill further including a supporting body which is arranged on the inner side of the cutting face and extends up to the end face, the cutting face being made of a harder material than the supporting body and the supporting body forms an annular web which is conical at least at an outer circumferential wall and which includes an inner circumferential wall which defines a free space at the end face;

wherein the cone angle of the inner circumferential wall and the cone angle of the cutting face differ from one another by less than about 8 degrees.

26. The roller drill as claimed in claim 15, wherein the free space includes a recess.

27. The roller drill as claimed in claim 26, wherein the free space extends from the end face at least partly over the axial extent of the cutting face of the tool.

28. A roller drill for removing material, such as in particular rock, minerals or the like, according to the undercutting principle, the roller drill comprising:

a cutting face which is formed concentrically around a central axis and widens conically toward an end face of the roller drill, the roller drill further including a supporting body which is arranged on the inner side of the cutting face and extends up to the end face, the cutting face being made of a harder material than the supporting body and the supporting body forms an annular web which is conical at least at an outer circumferential wall and which includes an inner circumferential wall which defines a free space at the end face;

wherein the supporting body has a cylindrical neck section and a conical collar section which at least in part forms the annular web; and wherein the supporting body has an inner bore which includes a clamping slope shaped to receive a clamping disk which interacts with the clamping slope for detachably connecting the roller drill to a tool shaft.

29. The roller drill as claimed in claim 28, wherein the clamping disk has a clamping slope with bevel and can be connected to an end of a tool shaft by means of a screw.

30. A roller drill for removing material, such as in particular rock, minerals or the like, according to the undercutting principle, the roller drill comprising:

a cutting face which is formed concentrically around a central axis and widens conically toward an end face of the roller drill, the roller drill further including a supporting body which is arranged on the inner side of the cutting face and extends up to the end face, the cutting face being made of a harder material than the supporting body and the supporting body forms an annular web which is conical at least at an outer circumferential wall and which includes an inner circumferential wall which defines a free space at the end face;

wherein the cutting face includes a plurality of cutting segments secured to the conically running outer circumferential wall of the annular web; and wherein the cutting segments are at least partially covered by a softer material layer than the cutting face.

31. The roller drill as claimed in claim 30, wherein the softer material layer includes at least one ring.

32. The roller drill as claimed in claim 30, wherein the softer material layer is softer than the material of the annular web.

* * * * *